US008495853B2

(12) United States Patent
Ten Donkelaar

(10) Patent No.: US 8,495,853 B2
(45) Date of Patent: Jul. 30, 2013

(54) INSERTING APPARATUS AND METHOD FOR INSERTING POSTAL ITEMS INTO ENVELOPES

(75) Inventor: Henkjan Ten Donkelaar, Opende (NL)

(73) Assignee: Neopost Technologies, Bagneux (FR)

( * ) Notice: Subject to any disclaimer, the term of this patent is extended or adjusted under 35 U.S.C. 154(b) by 486 days.

(21) Appl. No.: 12/719,923

(22) Filed: Mar. 9, 2010

(65) Prior Publication Data

US 2010/0229504 A1 Sep. 16, 2010

(30) Foreign Application Priority Data

Mar. 10, 2009 (EP) ..... 09154807

(51) Int. Cl.
*B65B 61/20* (2006.01)

(52) U.S. Cl.
USPC ..... 53/284.3; 53/467; 53/569; 53/381.5; 53/460

(58) Field of Classification Search
USPC ..... 53/467, 55, 58, 498, 500, 569, 284.3, 53/381.3, 381.5, 381.6, 460, 461; 493/186, 493/917
See application file for complete search history.

(56) References Cited

U.S. PATENT DOCUMENTS

| | | | | |
|---|---|---|---|---|
| 2,736,999 | A * | 3/1956 | Rouan et al. | 53/55 |
| 3,753,836 | A | 8/1973 | Buckholz | |
| 4,020,615 | A | 5/1977 | Irvine et al. | |
| 4,805,384 | A * | 2/1989 | DePasquale et al. | 53/569 |
| 5,247,780 | A * | 9/1993 | Kulpa et al. | 53/381.5 |
| 5,251,425 | A | 10/1993 | Kern | |
| 5,561,963 | A * | 10/1996 | Sytema et al. | 53/55 |
| 5,581,972 | A * | 12/1996 | Antonelli | 53/75 |
| 5,706,636 | A | 1/1998 | Eckl | |
| 5,992,132 | A * | 11/1999 | Auerbach | 53/569 |
| 6,508,463 | B1 | 1/2003 | Auerbach et al. | |
| 6,718,740 | B2 * | 4/2004 | Rivenbark et al. | 53/569 |
| 6,978,583 | B2 * | 12/2005 | Rozenfeld | 53/381.6 |
| 7,051,496 | B2 * | 5/2006 | Heilman | 53/569 |
| 7,254,931 | B2 * | 8/2007 | Stemmle et al. | 53/460 |
| 7,398,635 | B2 * | 7/2008 | Fairweather et al. | 53/569 |
| 2003/0009991 | A1 | 1/2003 | Iwamoto | |
| 2004/0108643 | A1 | 6/2004 | Pittelkow et al. | |
| 2010/0152009 | A1 * | 6/2010 | Edel | 493/210 |

FOREIGN PATENT DOCUMENTS

| | | | |
|---|---|---|---|
| DE | 9317366 | U1 | 1/1995 |
| EP | 0504114 | A1 | 3/1992 |
| EP | 0781671 | B1 | 8/1999 |
| EP | 1787823 | A1 | 5/2007 |
| EP | 2123474 | A1 | 11/2009 |
| EP | 2123475 | A1 | 11/2009 |

OTHER PUBLICATIONS

Extended European Search Report corresponding to European Patent Application No. 09 15 4807 dated Jun. 23, 2009.

* cited by examiner

*Primary Examiner* — M. Alexandra Elve
*Assistant Examiner* — Eyamindae Jallow
(74) *Attorney, Agent, or Firm* — Sughrue Mion, PLLC

(57) ABSTRACT

An inserting apparatus is equipped with a circulatable member arranged downstream of an envelope feeding path and rotatable about an axis transverse to the envelope feeding path. The circulatable member has envelope flap catcher members, each having a free edge arranged for entering between a flap and a body of an envelope fed along the envelope feeding path for engaging the flap and for holding the flap while the circulatable member is circulated so as to turn the flap to an opened position. An envelope support is provided for holding an envelope of which the opened flap is held by one of the catcher members of the circulatable member in an inserting position.

7 Claims, 8 Drawing Sheets

INSERTING APPARATUS AND METHOD FOR INSERTING POSTAL ITEMS INTO ENVELOPES

FIELD AND BACKGROUND OF THE INVENTION

The invention relates to an inserting apparatus and a method for inserting postal items into envelopes.

A continuous challenge in the design of envelope-stuffing machines is to increase output and reliability in an apparatus of limited costs.

One approach for increasing the speed at which postal items can be inserted into envelopes is disclosed in European patent application 0 504 114. According to this document, envelopes are pulled from a stack by means of rotating elements, which are part of a circulatable member and open the flap of each envelope. The envelopes are successively transported away from the circulatable member to an inserting position. After each envelope has reached the inserting position postal items are inserted therein and the envelope is then transported away from the inserting position vacating the inserting position for a next envelope to be filled.

According to U.S. Pat. No. 5,706,636, envelopes are spread and held ready for receiving postal items on a plurality of spreading members at different levels, wherein the individual spreading member picks up the opened envelopes in one conveying plane during the stopped phase and keeps the envelope received ready for pushing in the envelope contents in the other conveying plane. However, this requires a relatively complex construction.

U.S. Pat. No. 5,251,425, which is regarded as the closest prior art, discloses:

An inserting apparatus comprising; an envelope feeding path for feeding envelopes; a rotor, rotatable about an axis transverse to the envelope feeding path, the rotor comprising at least two envelope flap catcher members, each having a free edge facing the envelope feeding path when in a position aligned with a downstream end of the envelope feeding path, for entering between a flap and a body of an envelope fed along the envelope feeding path, for engaging the flap and for holding the flap while the rotor is rotated so as to turn the flap to an opened position; an envelope support adjacent to the rotor for holding an envelope of which the opened flap is held by one of the catcher members of the rotor; and an insert feeding path for feeding postal items into an envelope in the inserting position.

SUMMARY OF THE INVENTION

It is an object of the present invention to provide a solution which allows successive envelopes to be brought in an inserting position in an inserter quickly, but does not involve a complex construction.

According to the invention, this object is achieved by providing an inserter including;

an envelope feeding path for feeding envelopes;

a circulatable member arranged downstream of the envelope feeding path, the circulatable member comprising at least two envelope flap catcher members circulatable along a circulation path, the envelope flap catcher members each having a free edge facing the envelope feeding path when in a position aligned with a downstream end of the envelope feeding path, for entering between a flap and a body of an envelope fed along the envelope feeding path, the flap being hinged to the body of the envelope along a trailing edge of the envelope body, for engaging the flap and for holding the flap while the circulatable member is rotated so as to turn the flap to an opened position;

an envelope support adjacent to the circulatable member for holding an envelope of which the opened flap is held by one of the catcher members of the circulatable member in an inserting position; and an insert feeding path for feeding postal items into an envelope in the inserting position.

The invention can also be embodied in a method for inserting postal items into envelopes including;

successively feeding envelopes, each having an envelope body and flap hinged to the envelope body along a flap fold, along an envelope feeding path to a circulatable member with the flap fold trailing;

each time when a fold between a flap and a body of an envelope fed along the envelope feeding path reaches the circulatable member, causing a free edge of an envelope catcher member to engage the envelope between the flap and the envelope body of that envelope;

circulating the circulatable member while holding the flap against the catcher member so that the flap is pivoted to an open position;

holding the envelope of which the opened flap is held by one of the catcher members of the circulatable member in an inserting position; and feeding postal items into the envelope in the inserting position;

wherein each time an engaged one of the envelopes is held against one of the catcher members until after a next one of the envelopes has been engaged by another one of the catcher members.

The envelope flap catcher members, each when it is its turn, arrest a next one of the envelopes with the fold in a predetermined position, open the flap as the circulatable member is circulated, hold the envelope as it is brought to the inserting position and hold the envelope in the inserting position as it is spread for opening and the postal items are inserted therein. Because a plurality of such envelope flap catcher members are provided, a catcher member is already in position for arresting a next envelope before a previous envelope has vacated another one of the catcher members.

Particular elaborations and embodiments of the invention are set forth in the dependent claims.

Further features, effects and details of the invention appear from the detailed description and the drawings.

DETAILED DESCRIPTION

Figure 1:
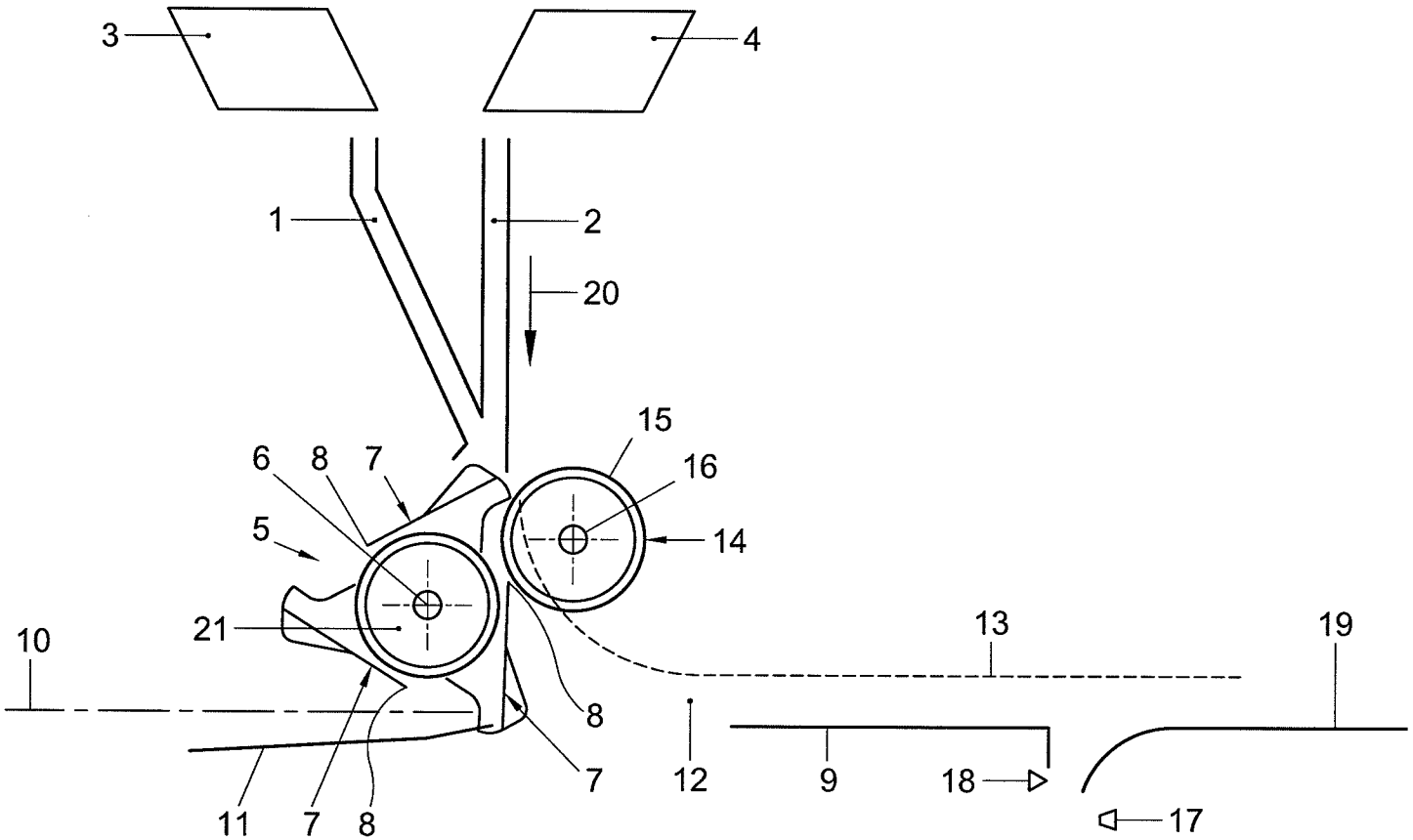
FIG. 1 is a schematic representation in side view of a first example of an inserter according to the invention.

The inserter according to the example shown in FIGS. 1-7 is first described with reference to FIG. 1. In FIGS. 2-7 the reference numbers shown in FIG. 1 are repeated only where this seems helpful.

The inserting apparatus shown has two envelope feeding paths 1, 2 for feeding envelopes from two envelope hoppers schematically represented by elements 3, 4 (not shown in FIGS. 2-7). The envelopes can be fed individually or in a mutually staggered configuration, each next envelope partially overlapping the previous envelope but with some distance in transport direction between trailing edges of successive envelopes.

A circulatable member in the form of a rotor 5 is arranged downstream of the envelope feeding paths 1, 2 and rotatable about an axis 6 transverse to the envelope feeding paths 3, 4. The rotor 5 is equipped with three envelope flap catcher members in the form of flat plates 7, each having a free edge 8 facing the envelope feeding paths 1, 2 for entering between a flap and a body of an envelope fed along the envelope feeding path 1, 2 when in a position aligned with a downstream end portion of the envelope paths 1, 2. The rotor 5 is arranged for clamping envelope flaps between each catcher member 7 and a central roller 21 in a sector of the paths of rotation of the catcher members 7 and for receiving and releasing envelope flaps in another sector of the paths of rotation of the catcher members 7.

An envelope support 9 is arranged adjacent to the rotor 6 for holding an envelope, of which the opened flap is held by one of the envelope flap catcher members 7 of the rotor 6, in an inserting position. An insert feeding path 10 for feeding postal items into an envelope in the inserting position 12 is bounded by a guide 11. A further guide 13 extends above the inserting position spaced from the support 9. A transport roller 14 is arranged opposite the rotor 5 and has a circumference 15 extending closely along a rotational path along which the leading edges 8 move if the rotor 5 rotates, for guiding envelopes closely along the leading edges 8. The transport roller is rotatable about an axis parallel to the axis of rotation 6 of the rotor 5.

Downstream of the support 9 and the inserting position 12, a flap moisturizer 17 is arranged for moistening glue on each flap in response to detection of the flap by a detector 18 as the envelope is transported away along an envelope discharge guide 19.

Figure 2:
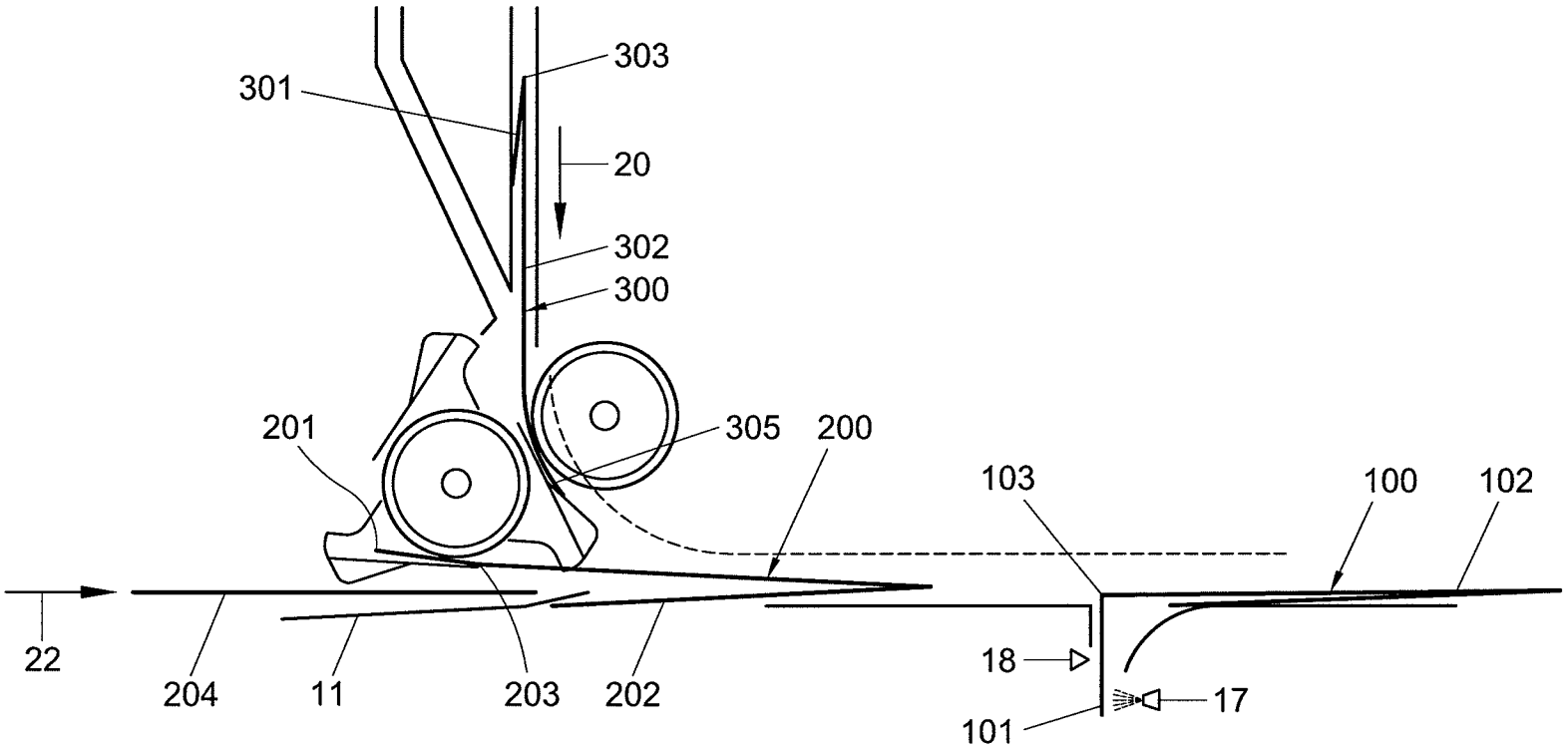
FIGS. 2-7 are schematic representations in side view of the inserter according to FIG. 1 in successive stages of operation.

In FIG. 2, the apparatus shown in FIG. 1 is shown in a stage of operation in which three envelopes 100, 200, 300 are being processed. The envelopes 100, 200, 300 each have a flap 101, 201, 301 hinged to an envelope body 102, 202, 302 of the envelope 100, 200, 300 along a fold 103, 203, 303 along a trailing edge of the envelope body 102, 202, 302.

The third envelope 300 is being fed along one of the envelope feeding paths 2 with the flap 301 folded in a direction extending in transport direction 20. A leading end 305 of the third envelope 300 has been guided to the outside of one of the catcher members 7 since it has reached that catcher member 7 before its free edge 8 was in alignment with the envelope feeding path 7.

The flap 201 of the second envelope 200 is being held between another one of the catcher members 7 and the central roller 21, since that catcher 7 is in the sector where it is pressed against the central roller 21. Radial movements of the elastically suspended catcher members 7 between the position for clamping an envelope flap against the central roller and the position for receiving and releasing an envelope flap between the catcher member 7 and the central roller 21 is operated by cams (not shown) engaging contact arms (not shown) projecting axially from the rotor 5. It is also possible to provide that the catcher members are in fixed positions relative to the centre of the rotor and that the rotor is equipped with radially movable clamping members, which may for instance be operated by cams or solenoids on the inside of the catcher members.

The body 202 of the second envelope 200 is in the inserting position and has been positioned with its throat over a downstream end of the inserting guide 11, so that the inserting guide 11 projects into the envelope body 202 holding a throat area of the envelope body 202 opened. A postal item 204 is being inserted into the envelope body 202 in an inserting direction 22 and guided into the envelope body 202 by the inserting guide 11.

The first envelope 100 is being moistened by the moistener 17 in response to detection by the detector 18.

Figure 3:
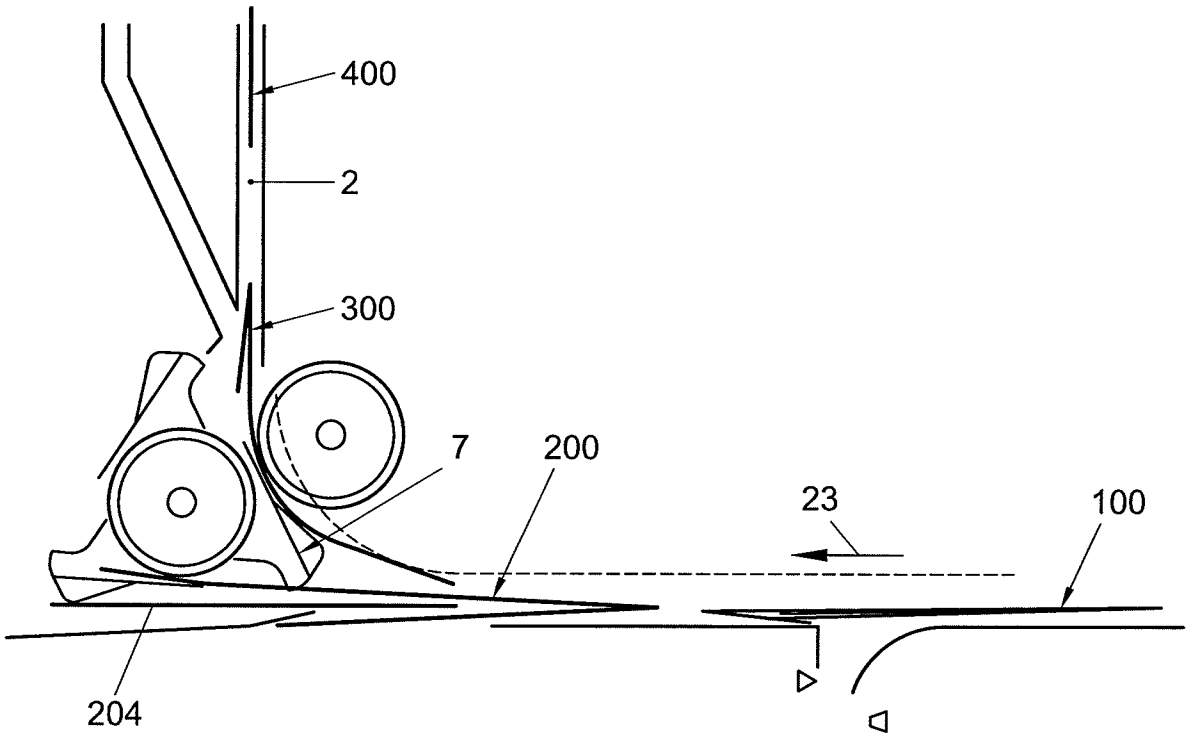

In FIG. 3, a fourth envelope 400 approaches along the envelope feeding path 2. The third envelope 300 is being passed further along the outside of one of the envelope catcher members 7. The postal items 204, for instance a letter with enclosures, are being passed further into body 202 of the second envelope 200. The first envelope 100 is being closed by briefly transporting the envelope 100 in a direction 23 opposite the insert direction 22.

Figure 4:
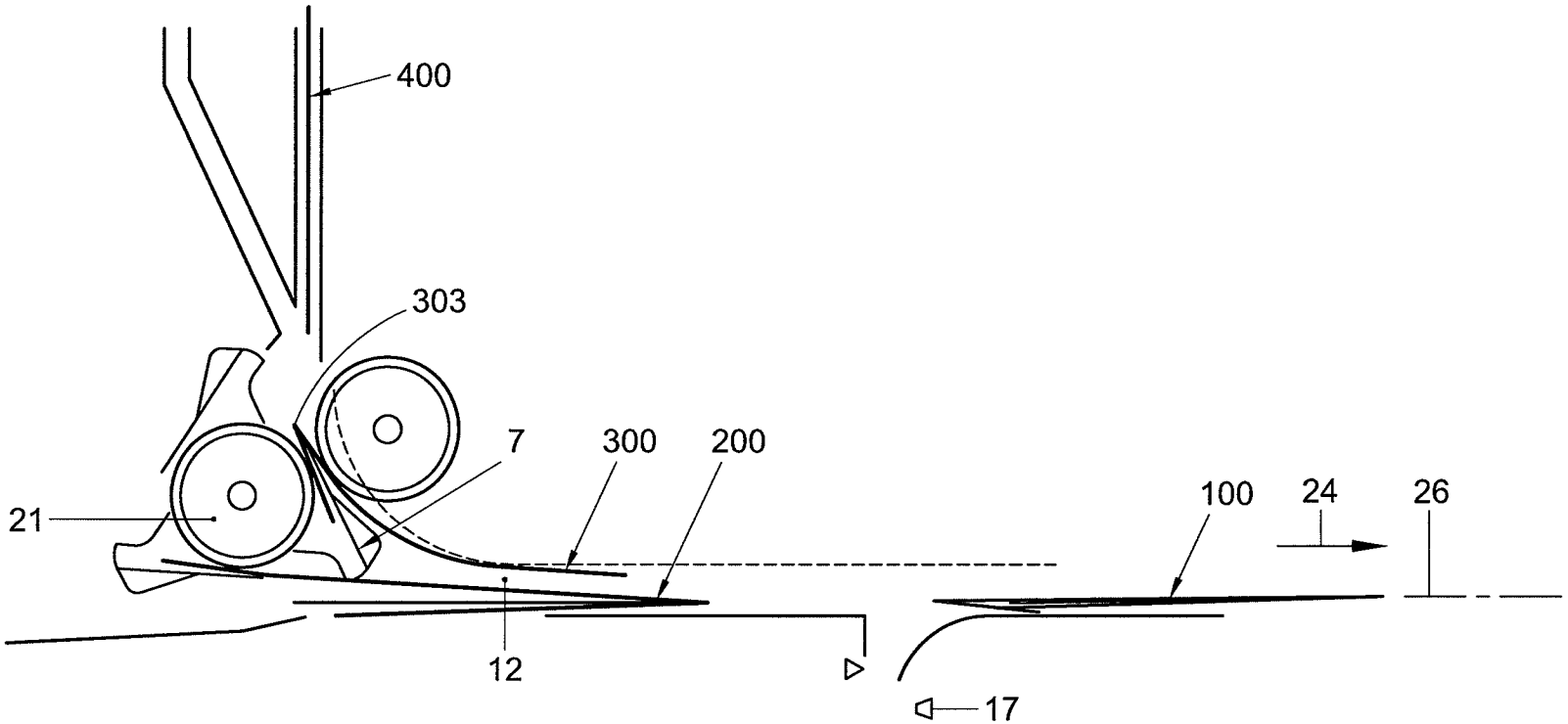

In FIG. 4, the fourth envelope 400 has been advanced to a waiting position in the envelope feeding path 2. The flap 301 of the third envelope 300 has been caught between one of the catcher members 7 and the central roller 21. A free edge 8 of that catcher member 7 has abutted in the trailing fold 303 between the flap 301 and the envelope body 302 of the third envelope 300. Thus, the envelope 300 has been caught with the fold 303 between its flap 301 and its envelope body 302 in a well controlled position.

A discharge path 26 is connected downstream to the inserting position 12 for discharging filled envelopes containing postal items inserted therein from the inserting position 12. The discharge path 26 and the inserting position 12 are arranged for discharging the filled envelope 200 while overlapping a next envelope 300 being brought into or brought in the inserting position. Thus, the third envelope 300 temporarily overlaps the second envelope 200 in the inserting position and is held ready to be brought in the inserting position in a position close to the inserting position. Accordingly, the third envelope 3000 can be brought in the inserting position 12 very quickly.

The set of postal items 204 completely inserted into the envelope body 202 of the second envelope 200 and the inserting guide 11 has been retracted relative to the inserting position shown in FIGS. 2 and 3 to a retracted position. The first envelope 100 is now fully closed and being transported in a discharge direction 24.

As can be seen from FIGS. 3 and 4, the envelope flap catcher members 7 of the rotors 5 are positioned relative to each other, the envelope feeding path 2 and the envelope support 9 for catching a flap 301 of a next envelope 300 while holding a flap 201 of a previous envelope 200 in the inserting position. This is advantageous for stuffing envelopes at a high production rate.

Figure 5:
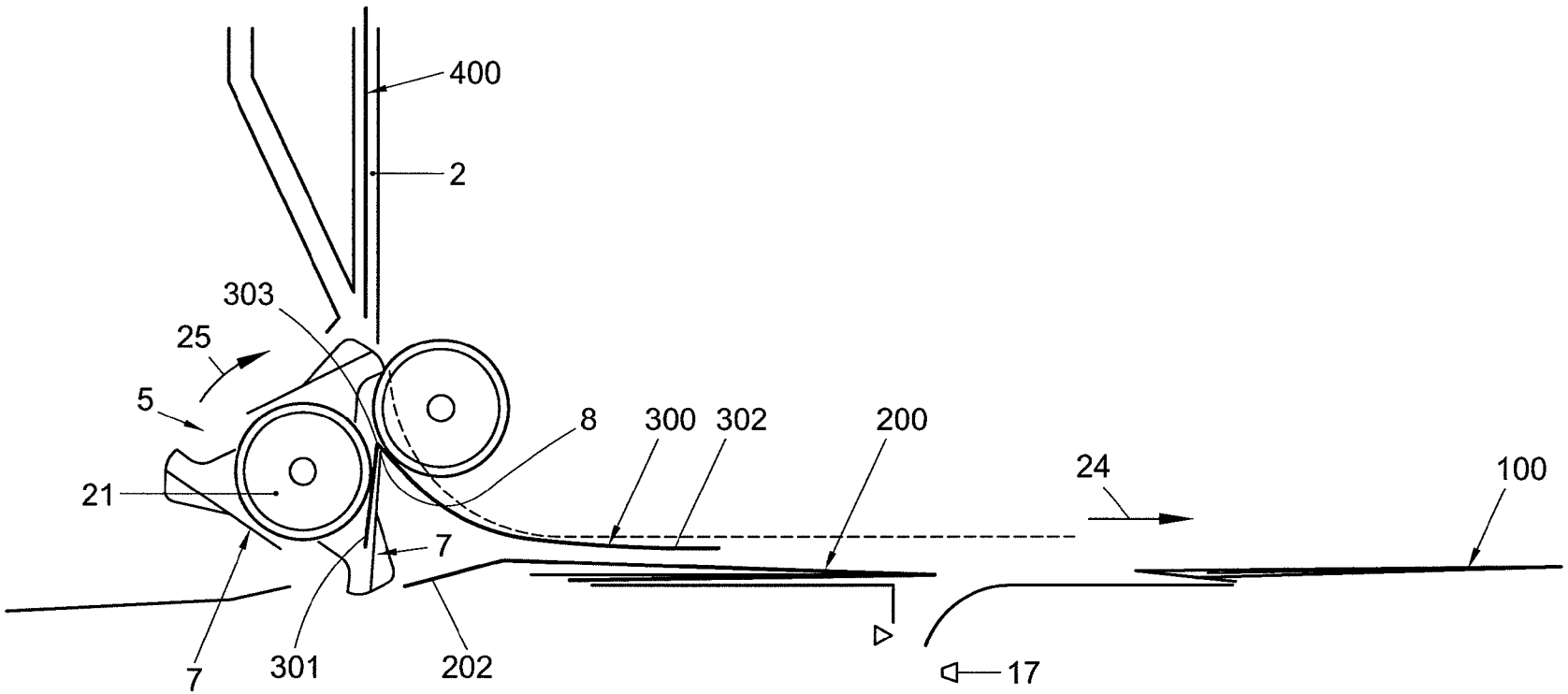

In FIG. 5, the fourth envelope is still in the waiting position. The rotor 5, which has been stationary thus far, is rotated in a sense of rotation 25 so that the free edge 8 of the catcher member 7 engaging the fold 303 between the flap 301 and the body 302 of the third envelope 300 moves away from the envelope feeding path 2. As the rotor rotates, the catcher member 7 engaging the third envelope 300 is moved from a position spaced from the central roller 21 to a position clamping the flap 301 of the third envelope 300 against the central roller 21. Meanwhile, the envelope body 302 of the third envelope 300 rests against the second envelope 200 so that the rotation of the flap 301 engaged by the rotor 5 causes the flap 301 to be pivoted away from the envelope body 302 as the rotor 5 rotates further. The rotation of the rotor 5 also causes the fold 303 of the third envelope to be displaced towards the position in which it is to be held while the associated postal items are inserted in the third envelope 300.

The rotation of the rotor 5 has also involved that the catcher member 7 holding the flap 202 of the second envelope 200 against the central roller 21 has been displaced radially away from the central roller 21, thereby releasing the flap 202 of the second envelope 200. The second envelope 200 is transported away in the discharge direction 24 towards the moistener 17.

Thus, the catcher members 7 also constitute a gripper structure including a plurality of grippers arranged in a sequence circulatable along the rotor, each gripper being movable for causing a flap of an envelope to be engaged thereby.

Figure 6:
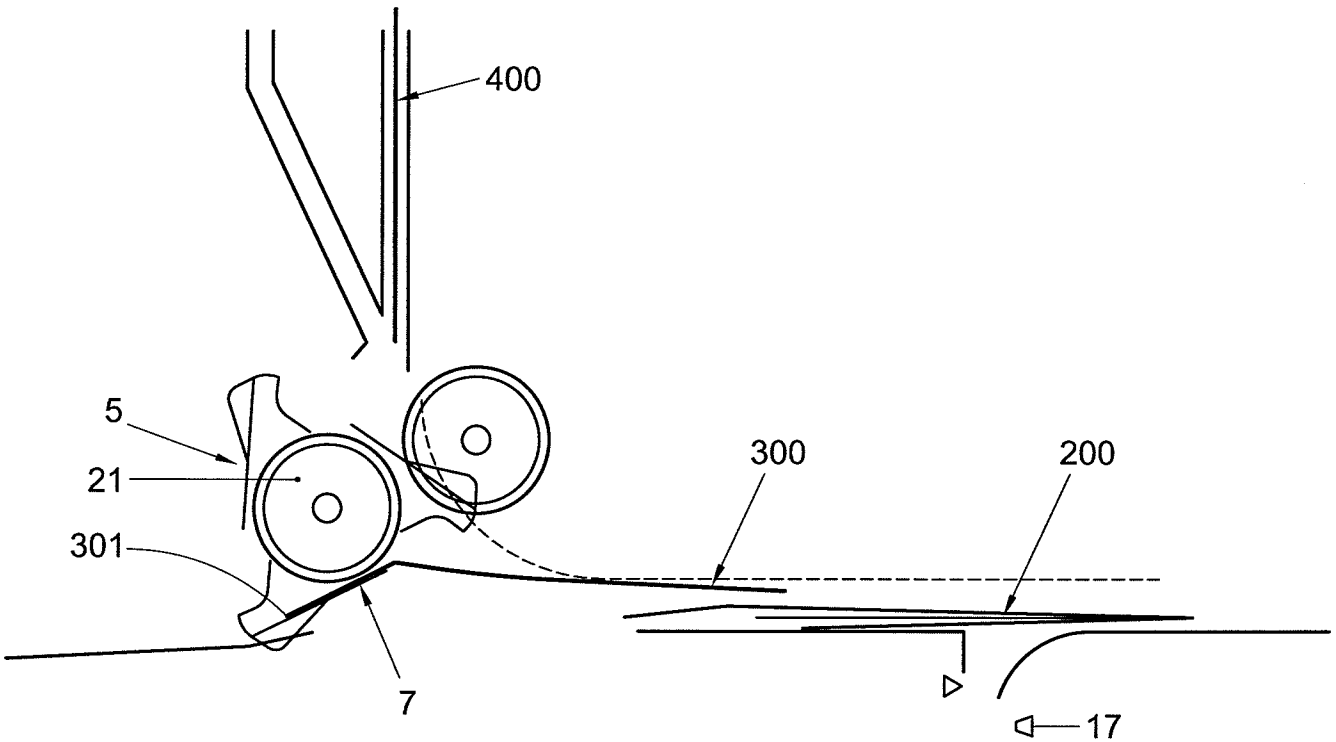

In FIG. 6 the rotor 5 is rotated further, thereby further opening the flap 301 of the third envelope 300, which flap 301 is further being held between one of the catcher members 7 and the central rotor 21 which rotate in unison. Meanwhile, the second envelope 200 is transported further towards the moistener 17.

Figure 7:
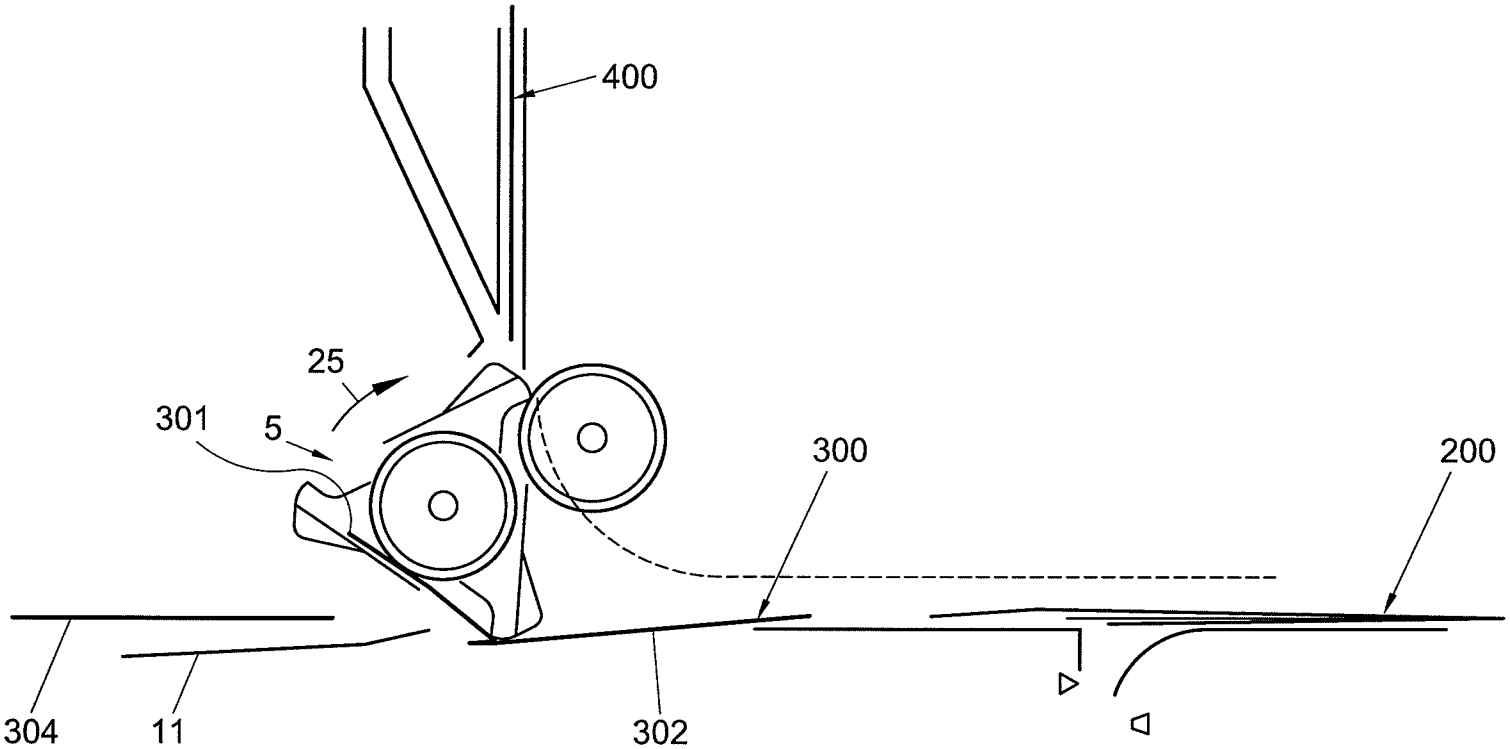

In FIG. 7, the rotor 5 has reached a position in which the throat of the envelope 300 is opened by bending the flap 301 held between one of the catcher members 7 and the central roller 21 as well as an adjacent portion of the envelope body 302 away from the remainder of the envelope body 302. This facilitates insertion of the inserting guide 11 into the throat of the envelope 300 prior to insertion of the contents 304 therein. As can be seen from FIG. 2, which would form the start of a next operating cycle, the rotor 5 is rotated back in a sense opposite the sense of rotation 25 before actually inserting the contents 304. This provides additional room between the inserting guide 11 and the wall of the envelope body 302 at the side of the flap 301.

Figure 8:
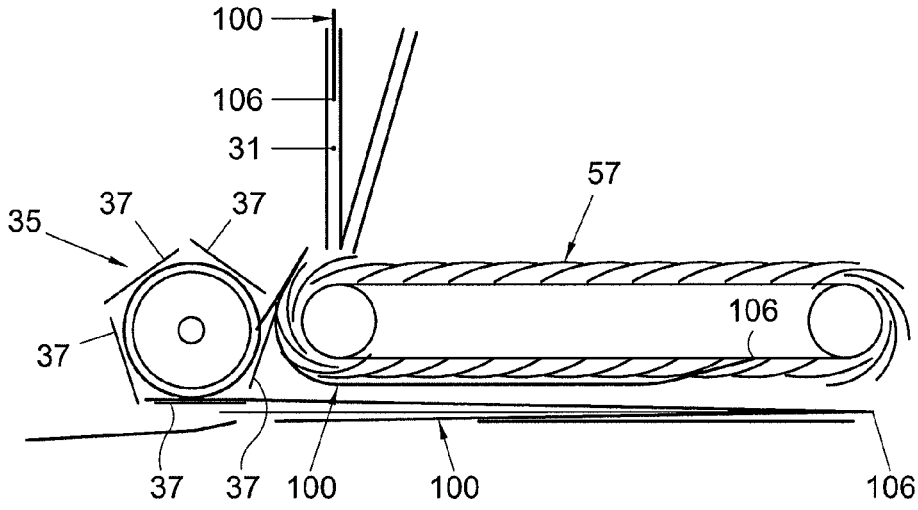
FIG. 8 is a schematic representation in side view of a second example of an inserter according to the invention.

In FIG. 8, a second example of an inserting apparatus according to the invention is shown. In this apparatus, leading edges 106 of envelopes 100 fed along an envelope feeding path 31 are caught between grippers of a gripper belt 57. An example of such a gripper belt is disclosed in applicant's European patent application with application number 09153993. The gripper belt 57 transports the envelopes along the rotor 35 which is equipped with five catcher members 37. The gripper chain 57 also ensures that the leading edge 106 of each envelope 100 is passed along a previous envelope in the inserting position before the envelope is engaged by a catcher member 37 which causes the leading end of the envelope 100 to be pulled out of the circulating gripper chain 57.

Figure 9:
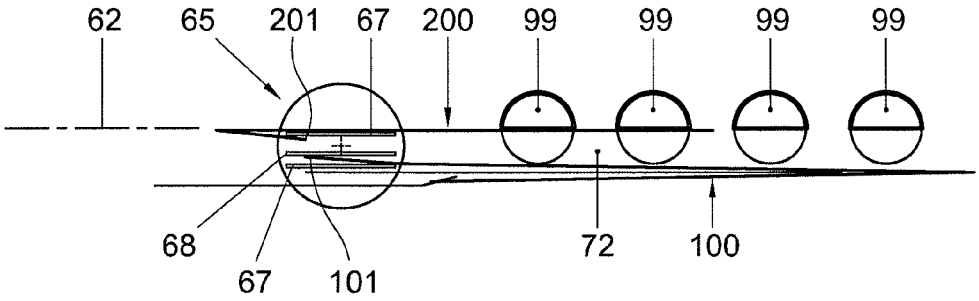
FIGS. 9 and 10 are schematic representations in side view of a third example of an inserter according to the invention in two stages of operation.
Figure 10:
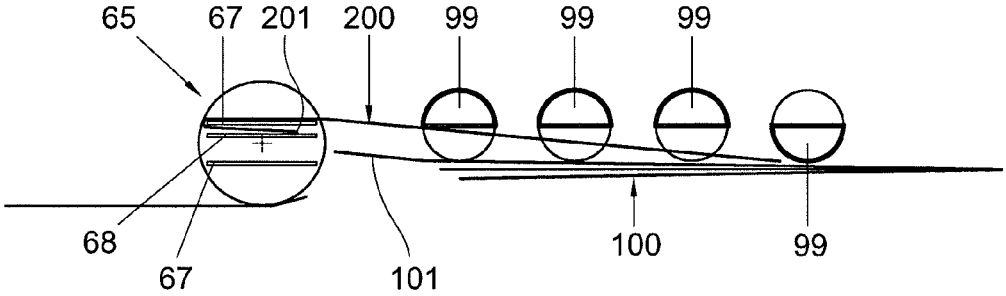

In FIGS. 9 and 10 a third example of an inserting apparatus according to the invention is shown, in which the rotor 65 is equipped with two catcher members 67. For feeding envelopes, an envelope feeding path 62 is provided. For clamping envelope flaps 101, 201 against the catcher members 67, the rotor is equipped with a clamp member 68 that is displaceable between a position for clamping a flap 101 of an envelope 100 against one of the catcher members 67 (FIG. 9) to a position for clamping another flap 201 of the next envelope 200 against the other one of the catcher members 67 (FIG. 10).

The inserting apparatus is further equipped with transport roller segments 99 spaced downstream from the rotor 65 along the inserting position 72. The transport roller segment 99 each have a circumference arranged for engaging an envelope 200 in the inserting position 72 and a clearance side leaving a space between an envelope 200 in the inserting position 72 and the clearance side if the clearance side is facing the inserting position 72. As is illustrated in FIG. 10, the transport roller segments 99 leave room for a next envelope 200 overlapping a previous envelope 100 that is vacating the inserting position 72. However, briefly before the next envelope 100 arrives, the transport roller segments 99 can be rotated so that the circular portions of the circumference face downwards, to impart an impulse in discharge direction upon the envelope 100 in the inserting position 72, so that this envelope 100 is reliably displaced away from the rotor 65 while keeping the inserted items in the still open envelope 100.

It will be clear to the skilled person, that many other variants are conceivable within the framework of the present invention. For instance, instead of in the form of a rotor, the circulatable member may be provided in the form of belt or a chain carrying the envelope flap catcher members so as to be circulatable along a circulation path. Also, the number of envelope flap catcher members may be different and other means for transporting filled envelopes away from the inserting position, such as vacuum grippers may be provided.

The invention claimed is:

1. An inserting apparatus for inserting postal items into envelopes, comprising:

an envelope feeding path for feeding envelopes;

a rotor arranged downstream of the envelope feeding path and rotatable about an axis transverse to the envelope feeding path, the rotor comprising at least two envelope flap catcher members each having a free edge facing the envelope feeding path when in a position aligned with a downstream end of the envelope feeding path, the flap catcher members enter between a flap and a body of an envelope fed along the envelope feeding path, the flap being hinged to the body of the envelope along a trailing edge of the envelope body, and which engage the flap and to hold the flap while the rotor is rotated so as to turn the flap to an opened position;

an envelope support adjacent to the rotor, the envelope support holding an envelope of which the opened flap is held by one of the flap catcher members of the rotor in an inserting position; and an insert feeding path which feeds postal items into an envelope in the inserting position, wherein the flap catcher members of the rotor are positioned relative to each other and to the envelope feeding path and to the envelope support, and catch a flap of a next envelope while holding a flap of an envelope in the inserting position.

2. An apparatus according to claim 1, further comprising a discharge path connected downstream to the inserting position, the discharge path discharging filled envelopes containing postal items inserted therein from the inserting position, the discharge path and the inserting position being configured to discharge the filled envelope while overlapping a next envelope being brought into or brought in the inserting position.

3. An apparatus according to claim 2, further comprising a gripper structure comprising a plurality of grippers arranged in a sequence circulatable with the rotor.

4. An apparatus according to claim 2, further comprising at least one transport roller segment spaced downstream from the rotor along the inserting position, the transport roller segment having a circumference configured to engage an envelope in the inserting position and a clearance side leaving a space between an envelope in the inserting position and the clearance side in response the clearance side facing the inserting position.

5. An apparatus according to claim 1, further comprising a clamp member which selectively clamps an envelope flap against any one of at least two of the catcher members.

6. An apparatus according to claim 1, further comprising at least one further envelope feeding path upstream of the rotor, at least two envelope hoppers, each envelope hopper being located upstream of one of the envelope feeding paths in order to feed envelopes into the respective one of the envelope feeding paths.

7. A method for inserting postal items into envelopes comprising:

successively feeding envelopes, each having an envelope body and flap hinged to the envelope body along a flap fold, along an envelope feeding path to a rotor with the flap fold trailing;

each time when a fold between a flap and a body of an envelope fed along the envelope feeding path reaches the rotor, causing a free edge of an envelope catcher member to engage the envelope between the flap and the envelope body of that envelope;

rotating the rotor about an axis transverse to the envelope feeding path while holding the flap against the catcher member so that the flap is pivoted to an open position;

holding the envelope of which the opened flap is held by one of the catcher members of the rotor in an inserting position; and feeding postal items into the envelope the inserting position;

wherein each time an engaged one of the envelopes is held against one of the catcher members until after a next one of the envelopes has been engaged-by another one of the catcher members.

* * * * *